United States Patent [19]

Kawakami et al.

[11] Patent Number: 4,893,953

[45] Date of Patent: Jan. 16, 1990

[54] PRINTER FOR NORMAL LINE FEED BY A CARRIAGE RETURN

[75] Inventors: Yuji Kawakami; Sae Kawakami, both of Nagoya, Japan

[73] Assignee: Brother Kogyo Kabushiki Kaisha, Aichi, Japan

[21] Appl. No.: 178,536

[22] Filed: Apr. 7, 1988

[30] Foreign Application Priority Data

Apr. 14, 1987 [JP] Japan ..... 62-91320

[51] Int. Cl.[4] ..... B47J 11/44; B41J 19/76

[52] U.S. Cl. ..... 400/582; 400/76; 400/551; 400/508; 400/904

[58] Field of Search ..... 400/65, 116, 117, 550, 400/551, 553, 904, 76, 582, 555, 583

[56] References Cited

U.S. PATENT DOCUMENTS

| | | | |
|---|---|---|---|
| 3,534,947 | 10/1970 | Willcox | 400/904 X |
| 4,037,705 | 7/1977 | Martin et al. | 400/904 X |
| 4,074,067 | 2/1978 | Speckhard | 400/904 X |
| 4,181,444 | 1/1980 | Heider | 400/551 X |
| 4,195,940 | 4/1980 | Rekewitz | 400/551 X |
| 4,224,869 | 9/1980 | Morin | 400/551 X |
| 4,606,664 | 8/1986 | Pascoe | 400/904 |
| 4,728,209 | 3/1988 | Kumamoto et al. | 400/904 X |
| 4,789,257 | 12/1988 | Brown, III et al. | 400/904 X |

FOREIGN PATENT DOCUMENTS

| | | | |
|---|---|---|---|
| 59089 | 4/1983 | Japan | 400/551 |
| 55774 | 3/1984 | Japan | 400/551 |
| 21274 | 2/1985 | Japan | 400/551 |
| 41073 | 2/1987 | Japan | 400/76 |

OTHER PUBLICATIONS

IBM Tech. Disc. Bulletin, "Automatic Platen Indexing System", Paulson, vol. 18, No. 10, Mar. 1976, p. 335.

*Primary Examiner*—William Pieprz
*Assistant Examiner*—James R. McDaniel
*Attorney, Agent, or Firm*—Oliff & Berridge

[57] ABSTRACT

Disclosed is a printer having memory means for storing the vertical print position movement data so as to print a super-script or sub-script character. When the carriage is returned after printing in a nonstandard row position, the print position is moved down by an adjusted line feed amount based on the vertical movement data stored in the memory means.

9 Claims, 6 Drawing Sheets

PRINTER FOR NORMAL LINE FEED BY A CARRIAGE RETURN

BACKGROUND OF THE INVENTION

This invention relates to a printer, especially to one in which the print position can move vertically to print a super-script character or a sub-script character.

It is widely known that a super-script character or a sub-script character (e.g. $x^2$, $A_{max}$) is printed by a printer in which either the printing head or printing paper is moved vertically.

When a return key is pressed on a typewriter or a return code is sent to a printer, the printing head moves both down (or the paper is fed upward) by a preset line feed amount and to a preset left margin position.

However, when the return key is pressed with the print position in a nonstandard row position to print a superscript or sub-script character, the print position moves down by the preset line feed amount from the abnormal position. If printing is continued on the new line, the vertical distance between the printed lines is different from the normal gap. Also, in case of a text data editing after a line feed code is entered in a text data in order to print a super-script or a sub-script character, the operator sometimes forgets to place the restore code in the text data in order to return the printing head to the predetermined standard row position.

Consequently, it causes a badly printed document having an irregularity in line spacings and deterioration in printing quality.

SUMMARY OF THE INVENTION

An object of this invention is to provide an improved printer in which, when a printing position is vertically moved from one of the predetermined standard row positions to print a super-script or sub-script character, the line feed amount can be adjusted in response to a carriage return code determined by the amount of vertical movement. Accordingly the vertical distance between the printed lines is kept constant and document is printed well.

The object and other related objects are realized by a printer of the invention which includes as shown in FIG. 1: line feed control means M1 for moving a print position vertically; memory means M3 for storing an amount of vertical movement of the print position from one of a plurality of predetermined standard row positions when the print position is moved vertically by the line feed control means M1 from one of said predetermined standard row positions, the distance between the predetermined standard row positions corresponding to a preset line feed amount; carriage return control means M2 responsive to a carriage return code for moving the print position down by the preset line feed amount by utilizing the line feed control means M1, and for moving the print position to a preset left margin position; and compensating means M4 for adjusting the preset line feed amount to be executed by the carriage return control means M2 based on the vertical movement data stored in the memory means M3. "Predetermined row position" refers to the position of a line separated from adjacent lines by a predetermined standard distance. The line feed control means M1 includes means to move the printing paper by a platen, or means to move the printing head vertically.

When this system is applied to a typewriter, the operator can type without worrying about any lines being typed in a nonstandard row position. Moreover, in case that it is applied to a printer, even if the operator forgets to enter the restore code in the printing data after introducing a super-script or sub-script code, the printing position is vertically moved an amount placing it at a standard row position, and returns to the standard row position at the next line. Accordingly, it is very easy to compensate after printing.

BRIEF EXPLANATION OF THE DRAWINGS

The present invention will now be described with reference to the accompanying drawings, in which.

DETAILED DESCRIPTION OF THE PREFERRED EMBODIMENT

Hereinafter, an embodiment of this invention will be described in detail according to FIGS. 2 through 6.

Figure 1:
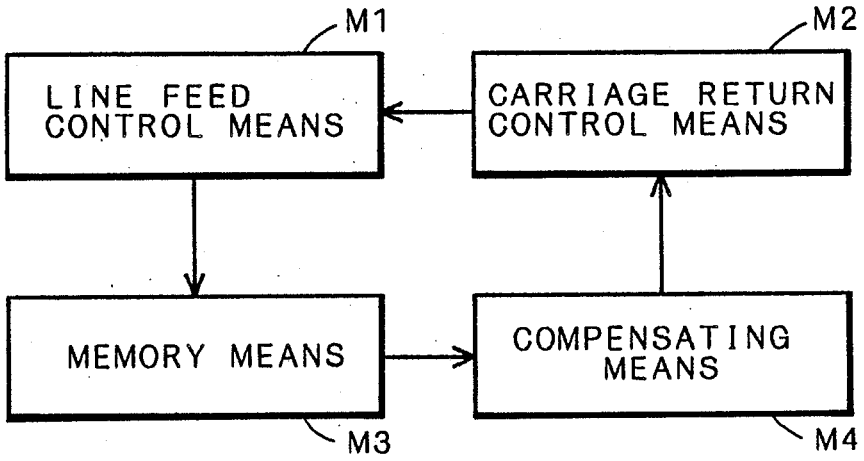
FIG. 1 is a schematic view illustrating the structure of the present invention.
Figure 2:
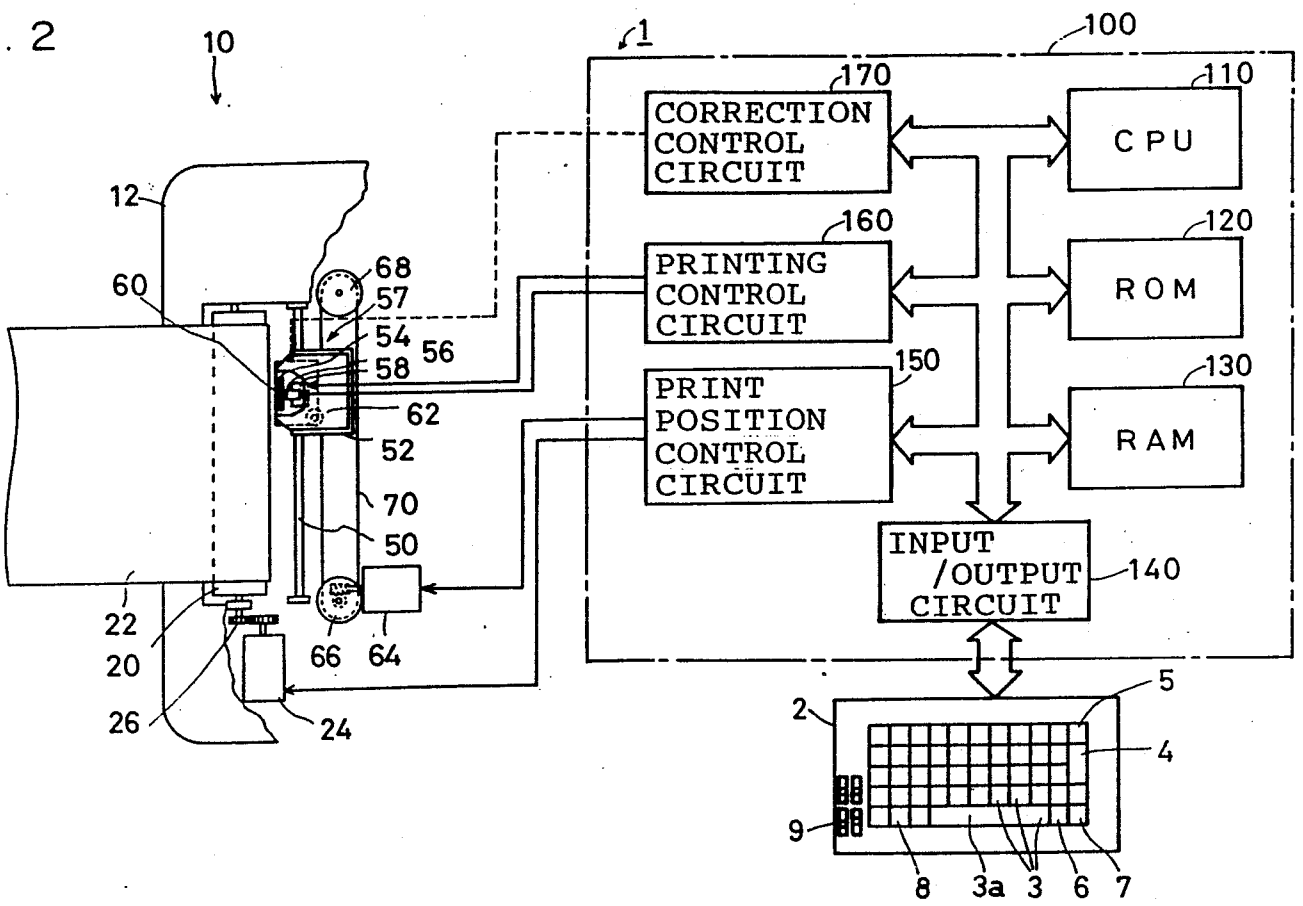
FIG. 2 is an explanatory view of an electronic typewriter in the embodiment of the present invention.

In FIG. 2, an electronic typewriter 1 includes a keyboard 2, a mechanism 10 and an electronic control unit 100.

The keyboard 2 has character keys 3 including a space key 3a, a return key 4, a backspace key 5, a super-script key 6, a sub-script key 7, a correction key 8, various function keys and switches such as a line space selector switch 9.

The mechanism 10 includes a platen 20 fixed on a frame 12 and a carriage 52 movably supported by a guide rod 50 provided in the frame 12 in parallel to the platen 20. A printing paper 22 is wound around the platen 20. A line feed stepping motor 24 for rotating the platen 20 and a gear mechanism 26 are provided in order to feed the printing paper 22 forward or backward. A printing head 57 having a daisy wheel 54, a printing hammer 56 and a character selection motor 58, a ribbon cassette 62 containing a printing ribbon 60, a well-known ribbon lift mechanism (not shown), a well-known ribbon roll-up mechanism, a well-known correction mechanism, etc. are mounted on the carriage 52. The carriage 52 is moved along the guide rod 50 by a carriage stepping motor 64, pulleys 66 and 68 at each end and a belt 70.

An electronic control unit 100 is a kind of microcomputer having a CPU 110, a ROM 120 and a RAM 130 and further including: an input/output circuit 140 for the keyboard 2; a print position control circuit 150 connected to the line feed stepping motor 24 and the carriage stepping motor 64; a printing control circuit 160 connected to the printing hammer 56, the character selection motor 58 and the ribbon mechanism; a correction control circuit 170 connected to the correction mechanism; bus lines to connect the above components and circuits, and so on.

According to various programs beforehand stored in the ROM 120 to control the typewriter 1, the CPU 110 receives printing data from the keyboard 2, controls the printing head 57, the carriage 52, the platen 20 via the control circuits 150, 160 and 170 and operates printing and movement of the printing head. The ROM 120 stores the above control programs, various data to initialize operation of the typewriter 1 and a table referred to in controlling. The RAM 130 includes a carriage status memory region to store the movement of the print position from any one of predetermined standard row position and other various regions to temporarily store data in operating the typewriter 1.

Operations responding to the character key 3, the return key 4, the super-script key 6 and the sub-script key 7 will be described based on flow charts of FIGS. 3 through 6. A line space is set at one sixth inch (SLS) by a switch 9.

When a key or a switch on the keyboard 2 is operated, the CPU 110 determines what kind of keys or switches is operated. If the super-script key 6 or the sub-script key 7 is operated, the operation proceeds according to the routine of FIG. 3. If the character key 3 including the space key 3a is operated, the operation proceeds according to the routine of FIG. 4. If the return key 4 is operated, the operation proceeds according to the routine of FIG. 5 or 6.

Figure 3:
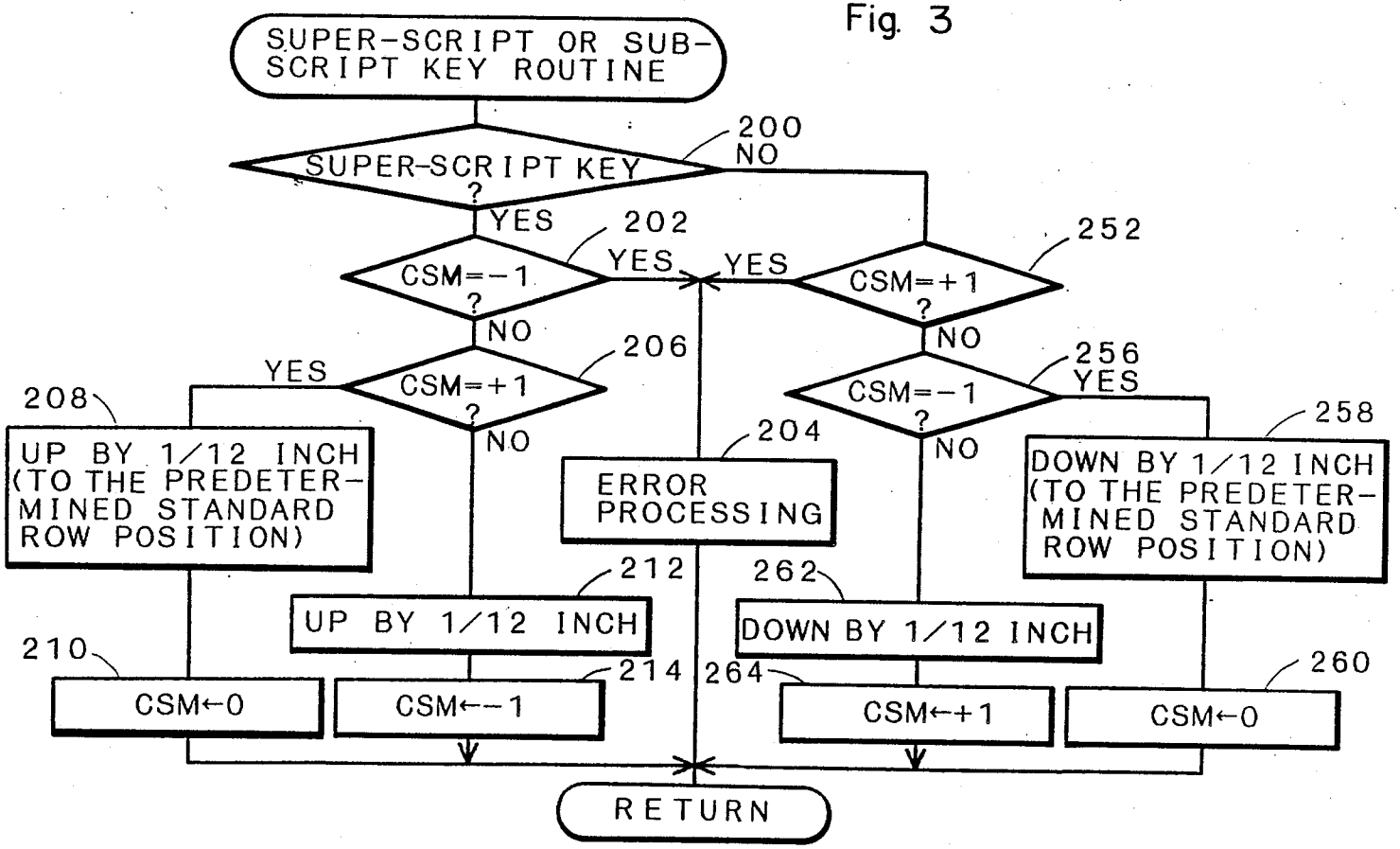
FIG. 3 is a flow chart of a routine for operations responsive to a super-script key or a sub-script key on the typewriter in the embodiment.

In FIG. 3, when the super-script key 6 or the sub-script key 7 is operated, it is determined at step 200 if the key is the super-script key 6 or the sub-script key 7. When it is determined that the super-script key 6 is operated, the process step 202 is executed to determine if, CSM (within carriage status memory) data value is −1 or not. The carriage status memory has a capacity of 2 bits, and the data corresponding to the super-script key 6 and the sub-script key 7 are assigned a value of −1 and of +1, respectively. In case that no key is operated and the printing line is located on a predetermined standard row position, 0 value is assigned to the CSM. The determination at step 202 that the CSM is −1 means that the super-script key 6 is repeatedly operated. Accordingly, an error processing is executed at step 204 and this routine ends. An alarm is usually sounded by the error processing.

When it is determined that the CSM is not −1 at step 202, the routine proceeds to step 206 where it is determined if the CSM is +1 or not. When the CSM is +1 at step 206, the routine proceeds to step 208 where the print position is moved up by one twelfth inch, namely, the line feed stepping motor 24 is driven to rotate reversely by the print position control circuit 150 so as to move the printing paper 22 backward. Consequently, the print position moves from the sub-script position to a predetermined standard row position, and the CSM returns to 0 at step 210.

When it is determined that the CSM is not +1 at step 206, namely, the CSM is 0, the print position is moved up by one twelfth inch at step 212. This is the super-script position. And after the print position is moved to the super-script position, the CSM becomes −1 at step 214 and this routine ends.

When it is determined that the operated key is not the super-script key 6 at step 200, namely, when the sub-script key 7 is operated, the processes are executed at steps 252 through 264 (like steps 202 through 214) for the movement of the print position and the setting of the CSM.

Figure 4:
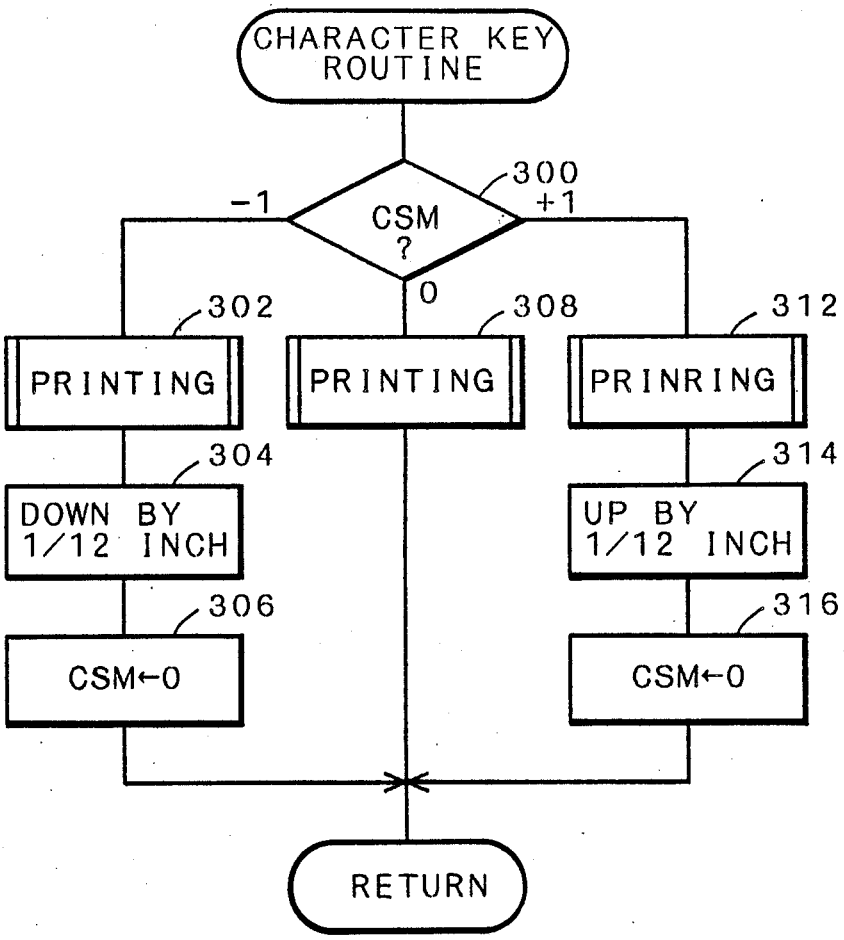
FIG. 4 is a flow chart of a routine for operations responsive to a character key or a space key.

When the space key 3a or the character key 3 is operated, the routine of FIG. 4 is executed. The CSM value is determined at step 300. When it is determined that the CSM is −1, namely, the print position is on the super-script position, the routine proceeds to step 302 where the character corresponding to the operated key is printed in the super-script position. This printing process also operates the carriage 52 to move right by one character after a type face of the daisy wheel 54 is hit via the printing ribbon 60 with the printing paper 22 by the printing hammer 56. The routine proceeds to step 304 where the print position is moved down by one twelfth inch and is returned to a predetermined standard row position. The CSM becomes 0 at step 306 and this routine ends. When it is determined that the CSM is +1 at step 300, the print position is brought into the sub-script position. The same operations as steps 302 through 306 are executed at steps 312 through 316. When it is determined that the CSM is 0, the print position is placed at a predetermined standard row position. In this case, the same printing operation as step 302 is executed at step 308 and this routine ends. Accordingly if the character is printed after the print position is vertically moved by the super script key 6 or sub-script key 7, the print position is automatically returned to a predetermined standard row position. The operator can type smoothly without returning the print position by himself.

Figure 5:
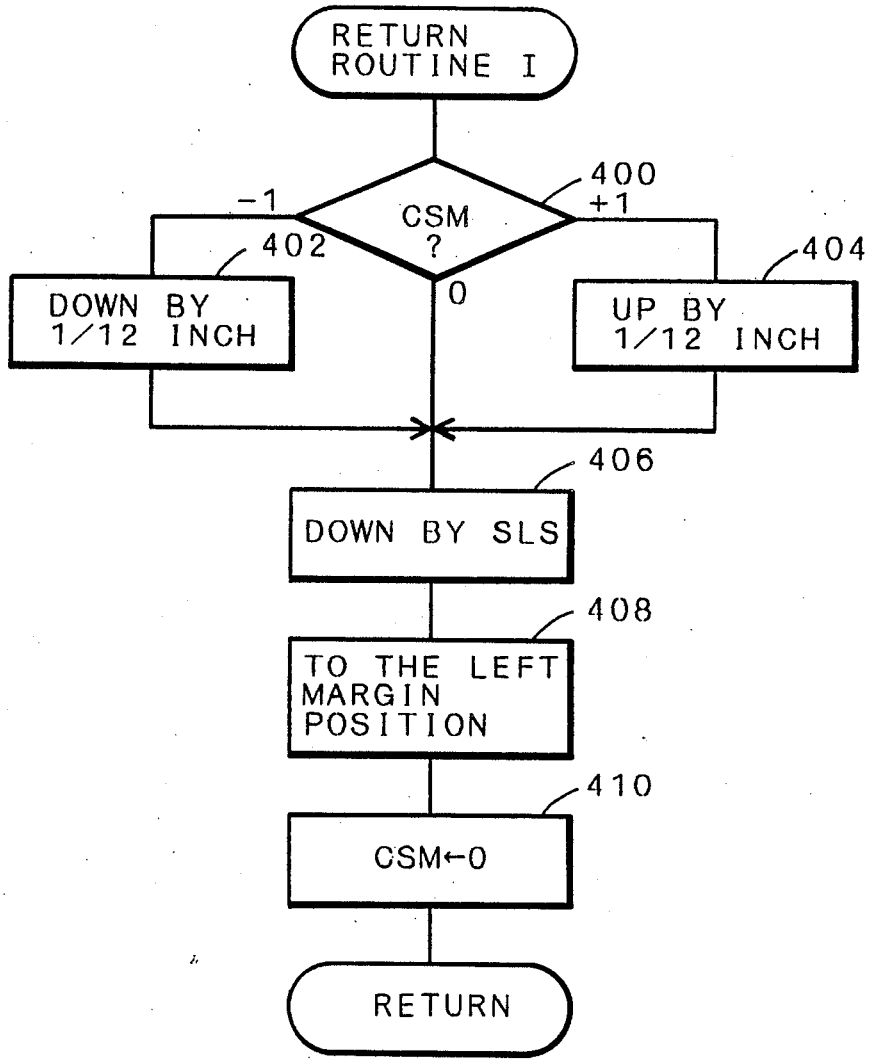
FIG. 5 is a flow chart of a routine for operations responsive to a return key.

When the return key 4 is operated, the routine of FIG. 5 is executed. First the CSM value is determined at step 400. When it is determined that the CSM is −1, the routine proceeds to step 402 where the print position is moved down by one twelfth inch and then returned from the super-script position to a predetermined standard row position. When it is determined that the CSM is +1, the print position is moved up by one twelfth inch and then returned from the sub-script position to a predetermined standard row position at step 404. No operation is executed when it is determined that the CSM is 0. After step 400, 402 or 404, the print position is moved down by SLS (one sixth inch in this case) at step 406, namely, the line feed stepping motor 24 is driven to rotate in the normal direction by the print position control circuit 150 so as to move the printing paper 22 up by one sixth inch. Accordingly, the print position is moved down by SLS to the next standard line. And the carriage stepping motor 64 is actuated so as to move the carriage 52 to a preset left margin position at step 408. This routine ends after the CSM becomes 0 at step 410. Accordingly, if the return key 4 is only pressed though the print position was vertically moved by prior operation of the super-script key 6 or the subscript key 7, the print position is automatically returned to a predetermined row position and the regular carriage return operation is executed by the typewriter 1.

Figure 6:
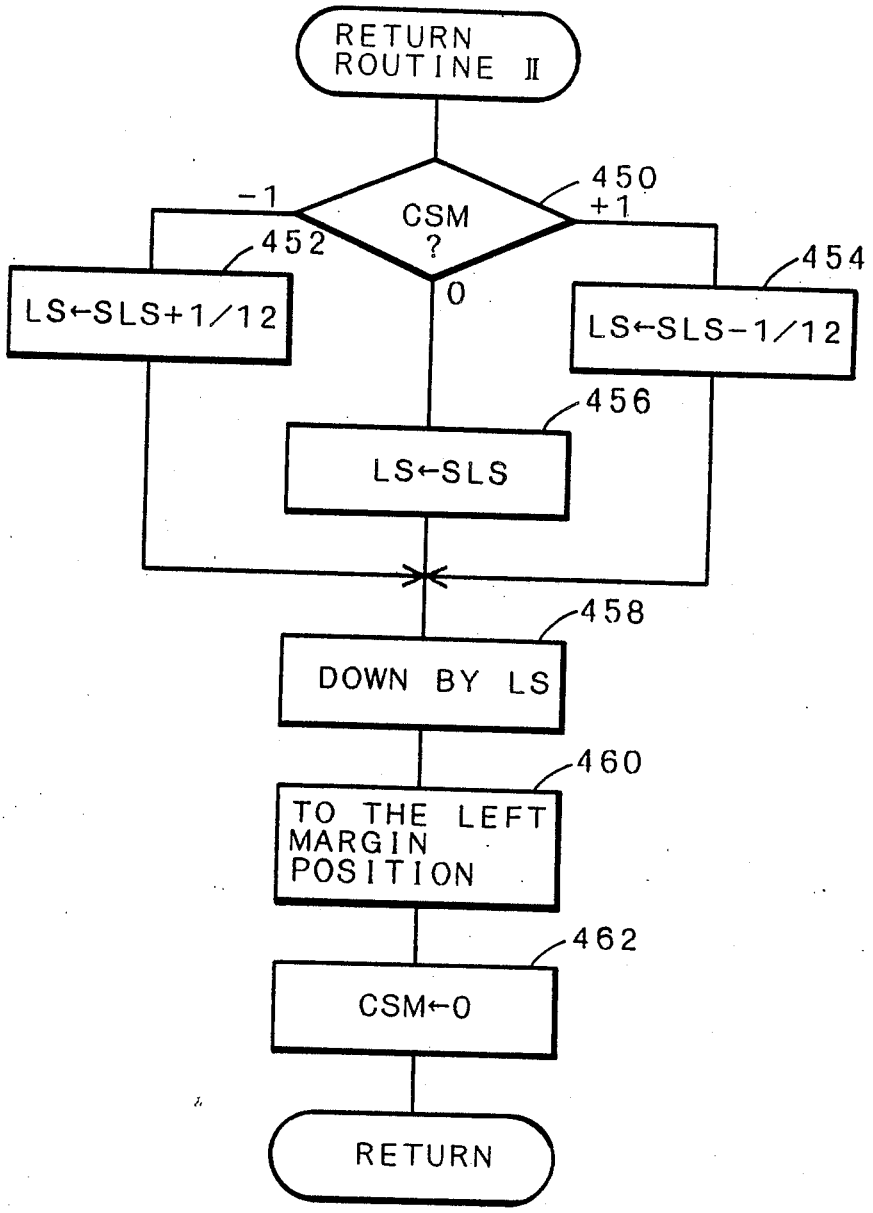
FIG. 6 is a flow chart illustrating another example of a routine for operations responsive to a return key.

When the return key 4 is operated, operation can be also executed according to the routine of FIG. 6. In this embodiment, a line feed amount LS is predetermined according to the CSM value when the return key 4 is operated. When it is determined that the CSM is −1 at step 450, the routine proceeds to step 452 where the LS is set equal to the sum of the preset line feed amount (SLS) plus one twelfth inch. When it is determined that the CSM is +1 at step 450, the routine proceeds to step 454 where the LS is set equal to the line feed amount (SLS) minus one twelfth inch. When it is determined that the CSM is 0 at step 450, the routine proceeds to step 456 where the LS is set equal to the SLS. The platen is rotated to move the print position down by the above-determined LS at step 458. The same operations as steps 408 and 410 are executed at steps 460 and 462, where the carriage 52 is returned to the preset left margin position and the CSM becomes 0, and this routine ends. According to this routine, when the return key 4 is operated, the platen 20 is not actually rotated to return the print position once to the original standard row position (as shown in steps 404, 406 of FIG. 5), but the print position is directly moved to the next standard row position. Elimination of such unnecessary movement of the platen 20 renders more accurate line feeding, because the mechanical backlash of the gear mechanism 26 is avoided, and higher typing speed.

In the above embodiment, the print position is moved vertically from a predetermined row position by operation of the super-script or sub-script key. However, the same action can be also executed by operating a line feed key as included in many other typewriters.

In the above embodiment, as shown in FIG. 4, if one of the characters is printed on the position which is vertically moved by the super-script key 6 or sub-script key 7, the print position is automatically returned to the predetermined standard row position. Advantages of the invention are better appreciated by applying the invention to such typewriters in which the print position is not automatically returned to the predetermined standard row position but the operator has to manually return the print position after a character is printed at the super-script or sub-script position.

Although the invention has been described with reference to specific embodiment thereof, it will be apparent that numerous changes and modifications may be made therein without departing from the scope of the invention. It is, therefore, understood that it is not intended to limit the invention to the embodiments shown but only by the scope of the claims which follow.

What is claimed is:

1. A printer comprising:

line feed control means for moving a print position vertically;

memory means for storing data of vertical movement of the print position from one of a plurality of predetermined standard row positions when the print position is moved vertically by the line feed control means from one of said predetermined standard row positions, distance between the predetermined standard row positions corresponding to a preset line feed amount;

carriage return control means responsive to a carriage return code for moving the print position down by the preset line feed amount by utilizing the line feed control means, and for moving the print position to a preset left margin position; and compensating means for adjusting the preset line feed amount to be moved by the carriage return control means based on the vertical movement data stored in the memory means.

2. A printer according to claim 1 wherein the line feed means comprises a platen and a platen motor for moving a paper vertically.

3. A printer according to claim 2 wherein the memory means stores an up/down direction data and an amount data of the vertical movement as the vertical movement data of the print position.

4. A typewriter comprising:

line feed control means responsive to a super-script key or a sub-script key for moving a print position vertically upward or downward by a preset distance out of one of a plurality of predetermined standard row positions;

memory means for storing data of vertical movement of the print position from one of said predetermined standard row positions when the print position is moved vertically by the line feed control means from one of said predetermined standard row positions, distance between the predetermined standard row positions corresponding to a preset line feed amount;

carriage return control means responsive to a carriage return key for moving the print position down by the preset line feed amount, and for moving the print position to a preset left margin position; and compensating means responsive to the carriage return key for adjusting the preset line feed amount based on the vertical movement data stored in the memory means when the print position is not in one of the predetermined standard row positions.

5. A typewriter according to claim 4, wherein the compensating means increases the preset line feed amount by the preset distance, whereby the carriage return control means moves the print position down by the increased line feed amount, when the print position is moved upward by the super-script key, and decreases the preset line feed amount by the preset distance, whereby the carriage return control means moves the print position down by the decreased line feed amount, when the print position is moved downward by the sub-script key.

6. A typewriter according to claim 4 wherein the memory means has a capacity of two bits and stores up/down print position movement data corresponding to operation of the super-script key or sub-script key.

7. A typewriter comprising:

line feed control means responsive to a super-script key or a sub-script key for moving a print position vertically upward or downward by a preset distance out of one of a plurality of predetermined standard row positions;

memory means for storing data of vertical movement of the print position from one of said predetermined standard row positions when the print position is moved vertically by the line feed control means from one of said predetermined standard row position, distance between the predetermined standard row positions corresponding to a preset line feed amount;

carriage return control means responsive to a carriage return key for moving the print position down by the preset line feed amount, for moving the print position to a preset left margin position, and for returning the print position to next predetermined row position based on the vertical movement data stored in the memory means when the print position is not in one of the predetermined row position.

8. A typewriter according to claim 7, wherein the carriage return control means moves the print position down by the preset line feed amount plus the preset distance when the print position is moved upward by the super-script key, and moves the print position down by the preset line feed amount minus the preset distance when the print position is moved downward by the sub-script key.

9. A typewriter according to claim 6 wherein the memory means has a capacity of two bits and stores up/down print position movement data corresponding to operation of the super-script key or sub-script key.

* * * * *